US010976135B1

(12) United States Patent
Holland

(10) Patent No.: US 10,976,135 B1
(45) **Date of Patent: *Apr. 13, 2021**

(54) QUICK AIM RETICLE

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,978

(22) Filed: May 28, 2019

Related U.S. Application Data

(63) Continuation-in-part of application No. 15/950,464, filed on Apr. 11, 2018, now Pat. No. 10,302,395.

(51) Int. Cl.
*F41G 1/38* (2006.01)
*F41G 3/06* (2006.01)

(52) U.S. Cl.
CPC ..... *F41G 3/06* (2013.01)

(58) Field of Classification Search
CPC ... F41G 1/38; F41G 1/473; F41G 3/06; G02B 27/32; G02B 23/14
USPC ..... 42/122, 130; 356/21; 89/41.17
See application file for complete search history.

(56) References Cited

U.S. PATENT DOCUMENTS

| | | | |
|---|---|---|---|
| 1,190,121 | A | 7/1916 | Critchett |
| 3,190,003 | A | 6/1965 | O'Brien |
| 3,392,450 | A | 7/1968 | Herter et al. |
| 3,744,133 | A | 7/1973 | Fukushima et al. |
| 3,782,822 | A | 1/1974 | Spence et al. |
| 3,826,012 | A | 7/1974 | Pachmayr |
| 3,862,012 | A | 1/1975 | Stork |
| 3,948,587 | A | 4/1976 | Rubbert |
| 3,990,155 | A | 11/1976 | Akin et al. |
| 4,263,719 | A | 4/1981 | Murdoch |
| 4,389,791 | A | 6/1983 | Ackerman |
| 5,491,546 | A | 2/1996 | Wascher |
| 5,499,455 | A | 3/1996 | Palmer |
| 5,920,995 | A | 7/1999 | Sammut |
| 5,960,576 | A | 10/1999 | Robinson |
| 6,357,158 | B1 | 3/2002 | Smith |
| 6,453,595 | B1 | 9/2002 | Sammut |
| 6,516,551 | B2 | 2/2003 | Gaber |
| 6,516,699 | B2 | 2/2003 | Sammut et al. |
| 6,591,537 | B2 | 7/2003 | Smith |
| 6,609,325 | B2 | 8/2003 | Harris |
| 6,681,512 | B2 | 1/2004 | Sammut |
| 6,729,062 | B2 | 5/2004 | Thomas |
| 6,772,550 | B1 | 8/2004 | Leatherwood |
| 7,738,082 | B1 * | 6/2010 | Peters ..... F41G 3/02 356/4.01 |

(Continued)

*Primary Examiner* — Michael D David
(74) *Attorney, Agent, or Firm* — Timothy E. Siegel Patent Law, PLLC; Timothy E. Siegel

(57) ABSTRACT

A rifle and rifle scope assembly, including a rifle and a rifle scope housing, attached to the rifle, the housing defining an eyepiece. An optical train is supported in the housing and includes a reticle lens. The reticle is arranged so that when a user looks through the eyepiece, the reticle lens presents a display having a set of vertical bars of different heights, wherein the height of each vertical bar corresponds to the vertical space on the reticle of a target of a known height and at a first known range. Further, a numeral adjacent to each vertical bar, provides the height in units of length, of a target that will appear as being the same height as the vertical bar, when viewed through the scope, if the target is at the known distance.

7 Claims, 9 Drawing Sheets

(56) References Cited

U.S. PATENT DOCUMENTS 7,856,750 B2 12/2010 Sammut et al.
7,926,408 B1 * 4/2011 Kley ..... F41G 1/02 89/41.17
8,109,029 B1 2/2012 Sammut et al.
8,230,635 B2 * 7/2012 Sammut ..... F41G 3/06 42/122
8,353,454 B2 * 1/2013 Sammut ..... F41G 3/08 235/404
8,656,630 B2 * 2/2014 Sammut ..... F41G 1/38 42/122
8,910,412 B2 * 12/2014 Mikroulis ..... F41G 3/06 42/122
8,959,824 B2 * 2/2015 Sammut ..... F41G 1/473 42/122
8,966,806 B2 3/2015 Sammut et al.
9,068,799 B1 * 6/2015 Wu ..... F41G 1/38
9,297,615 B2 * 3/2016 Meinert ..... F41G 1/18
9,335,123 B2 5/2016 Sammut
10,302,395 B1 5/2019 Holland
2003/0145505 A1 8/2003 Kenton
2005/0229468 A1 10/2005 Zederey
2012/0046100 A1 * 2/2012 Roman ..... F41G 1/467 463/30
2014/0370993 A1 * 12/2014 Roman ..... F41G 1/467 463/51
2015/0034722 A1 * 2/2015 Roman ..... F41G 1/467 235/404
2015/0233675 A1 * 8/2015 Roman ..... F41G 3/06 235/407
2015/0241172 A1 * 8/2015 Roman ..... F41G 3/165 235/404
2016/0069643 A1 * 3/2016 Lyren ..... G06T 11/60 345/589
2016/0084617 A1 * 3/2016 Lyren ..... F41G 3/08 42/135

* cited by examiner

QUICK AIM RETICLE

RELATED APPLICATIONS

This application is a continuation-in-part of application Ser. No. 15/950,464, filed Apr. 11, 2018 which is incorporated by reference as if fully set forth herein.

BACKGROUND

Hunting for deer requires quick decision making. Time required to make calculations can be time that a deer uses to move on to more inviting forage, leaving the hunter's field of view. Accordingly, a system that can be used in a brief moment, and without needing to take one's eye from a scope eyepiece, is advantageous.

Also, increasingly common timed shooting competitions require participants to navigate a course, while shooting at targets, some of which are human shaped. If a participant uses a laser range finder, the time to read the laser range finder and adjust the elevation knob accordingly is time lost in negotiating the course. A faster way of ranging and aiming would provide a competitor with an advantage, in finishing the course quickly. Many shooters use pellet guns, particularly for short range target practice, shooting at, for example vegetable-juice cans, to help improve aim and for a moment's recreation.

Another issue in the ability to rapidly aim and shoot, is directing the rifle's barrel at an upward angle, enough to compensate for bullet drop due to gravity. Different approaches to finding the correct elevation angle include reticle markings that are a uniform angular distance apart and elevation knobs that permit the scope line-of-sight to be pointed down relative to the rifle, according to the turn of the knob. Each of these methods require some calculation to translate from target range to elevation angle that accurately compensates for target range.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a rifle and rifle scope assembly, including a rifle and a rifle scope housing, attached to the rifle, the housing defining an eyepiece. An optical train is supported in the housing and includes a reticle lens. The reticle is arranged so that when a user looks through the eyepiece, the reticle lens presents a display having a set of first horizontal lines, each marked by an indicium and a set of second horizontal lines, each marked by an indicium. Further, a first one of the first horizontal lines and a first one of the second horizontal lines form a first pair of lines, spaced apart by a distance that fits the distance on an m-target from the belt to the top of the head as seen through the scope, if the m-target is at a range that results in bullet drop of a first known amount, for a first known cartridge type. Also, the first one of the first horizontal lines is labeled with a first indicium and wherein a set of marks includes a first mark which will, if placed on a target, result in an elevation angle, relative to the target, that will compensate for the first known amount of bullet drop, for the first known cartridge type, and wherein the first mark is also marked with the first indicium. Accordingly, a user can determine that an m-target fits the first pair of lines, from belt to head-top, read the first indicium, find a mark marked with the first indicium, position the rifle so that when the user views the m-target through the eyepiece, the mark is superimposed on the m-target, and shoot, thereby quickly compensating for bullet drop at range, for the first known cartridge type, to the m-target.

In a second separate aspect, the present invention may take the form of a rifle and rifle scope assembly, including a rifle and a rifle scope housing, attached to the rifle, the housing defining an eyepiece. An optical train is supported in the housing and includes a reticle lens. The reticle is arranged so that when a user looks through the eyepiece, the reticle lens presents a display having a set of vertical bars of different heights, wherein the height of each vertical bar corresponds to the vertical space on the reticle of a target of a known height and at a first known range. Further, a numeral adjacent to each vertical bar, provides the height in units of length, of a target that will appear as being the same height as the vertical bar, when viewed through the scope, if the target is at the known distance.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Definition: a man of average dimensions or target in the form a silhouette of a man (a "silhouette target"), are henceforth collectively referred to as an "m-target", with references to a "belt," or "head" in the context of a silhouette target, to be interpreted as representing the position on the silhouette target corresponding to the location where a man typically wears a belt, or the head, respectively. It is common for silhouette targets to be used in shooting competitions, including timed shooting competitions and competitions in which a course is navigated while shooting at targets.

Figure 1:
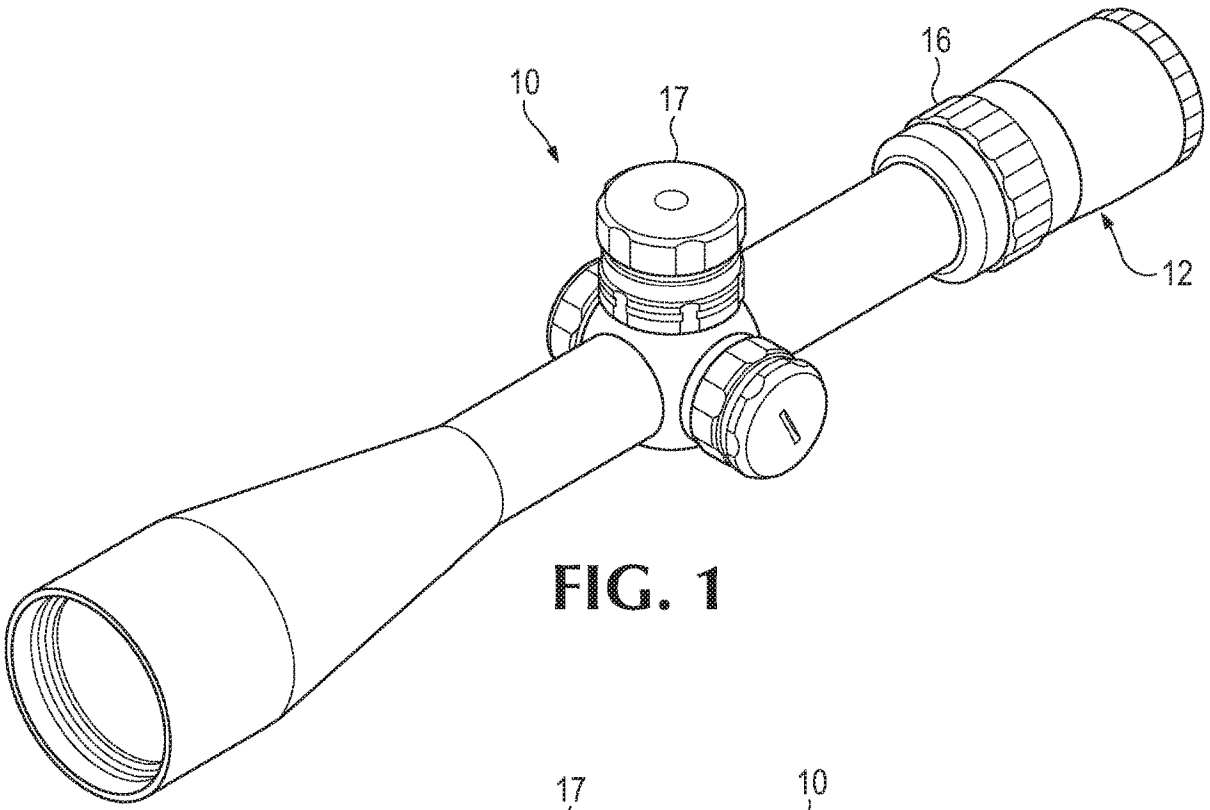
FIG. 1 is an isometric view of a rifle scope according to the present invention.
Figure 2:
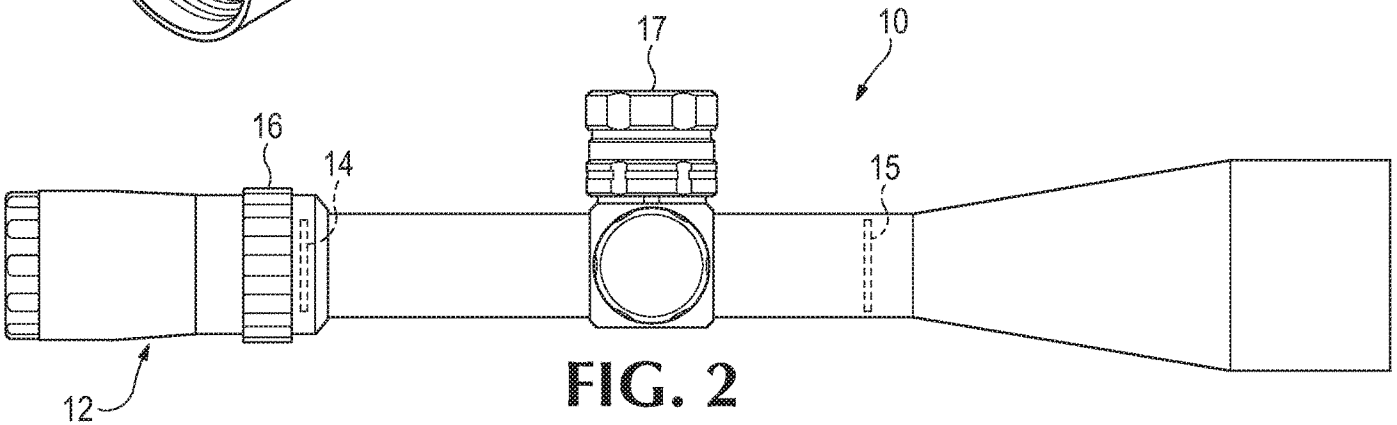
FIG. 2 is a side view of the rifle scope of FIG. 1.

Referring to FIGS. 1 and 2, a rifle scope 10, according to a preferred embodiment of the present invention, includes an eyepiece 12, a reticle lens 14, positioned in the second focal plane, and a zoom selector or power ring 16. In embodiments, scope 10 is attached to a rifle by a well-known method, such as by way of a Picatinny rail, to form a scope and rifle assembly (not shown). In an alternative embodiment, the reticle lens 14 is positioned in the first focal plane 15. An elevation knob 17 permits adjustment of the elevation of the reticle marks as seen by a user, versus the actual pointing direction of the scope 10 (and thereby the attached rifle).

Figure 3:
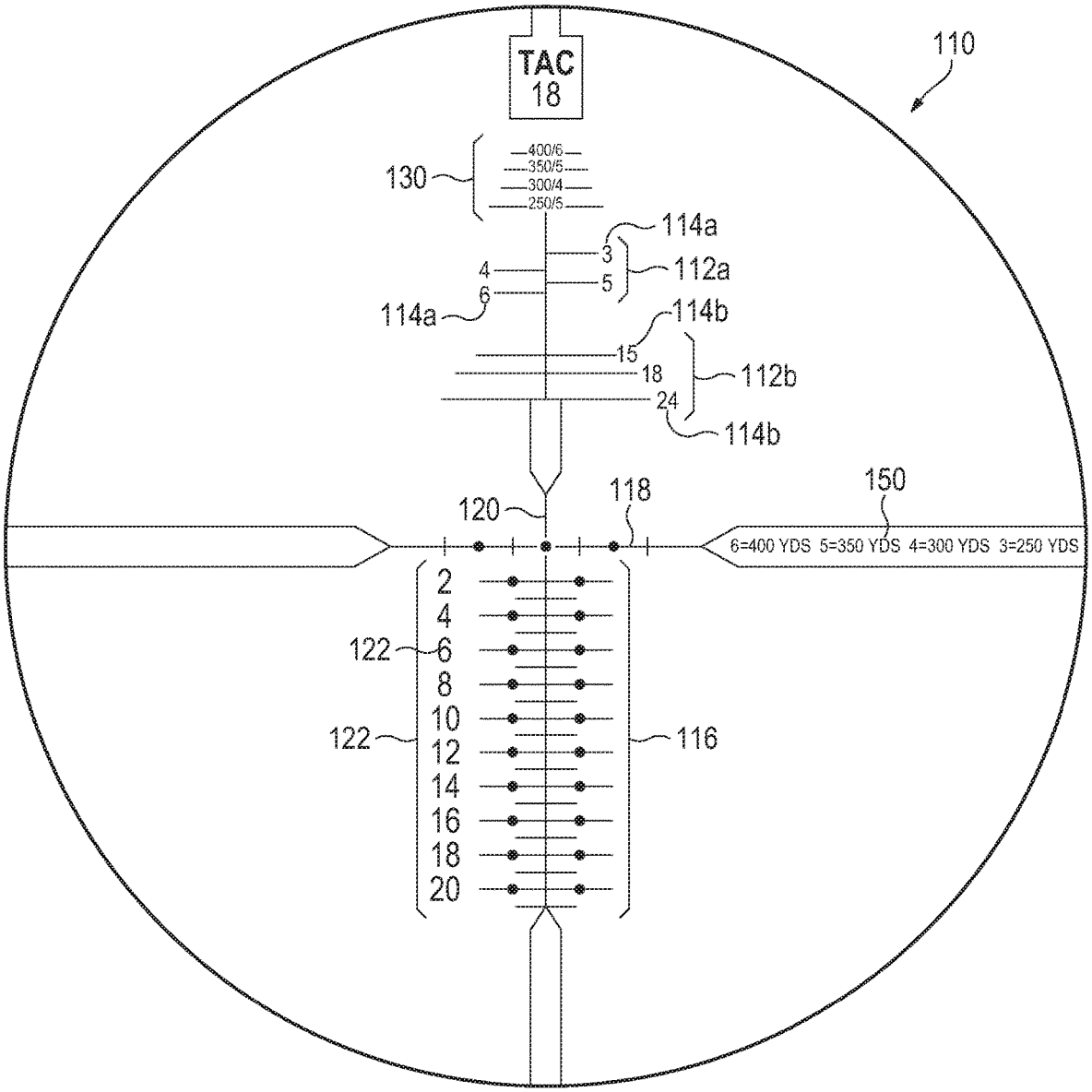
FIG. 3 is a reticle as seen through the scope of FIG. 1.

Referring to FIG. 3, a hunter viewing through the rifle scope 10 (attached to a rifle to form an assembly of rifle and scope) sees the reticle design 110 shown. For the embodiment in which the reticle lens is positioned in the second focal plane, the markings shown correspond to the highest level of scope magnification. The hunter may line up a target of known height, so that it is between, or subtends, a pair of lines, with a first line of the pair selected from a set of first lines 112*a*, and the second line of the pair selected from a set of second lines 112*b*, with both sets situated in the upper portion of the field of view. The set of first lines 112*a* are each marked with an indicium 114*a*, and the set of second lines 112*b* are each marked with an indicium 114*b*.

Figure 4A:
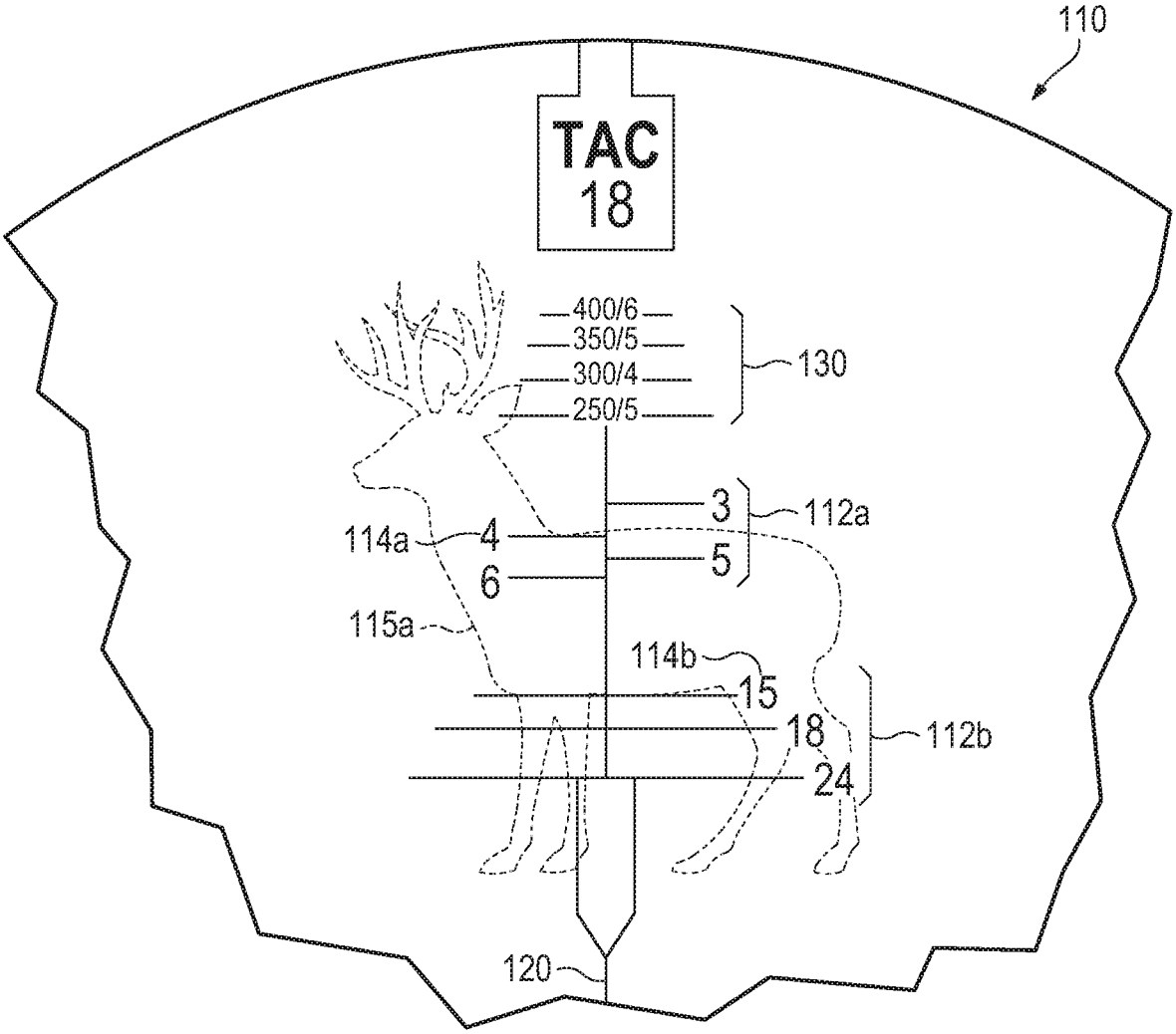
FIG. 4*a* is a view of a black tail buck at 300 yards, on the reticle of FIG. 3.
Figure 4B:
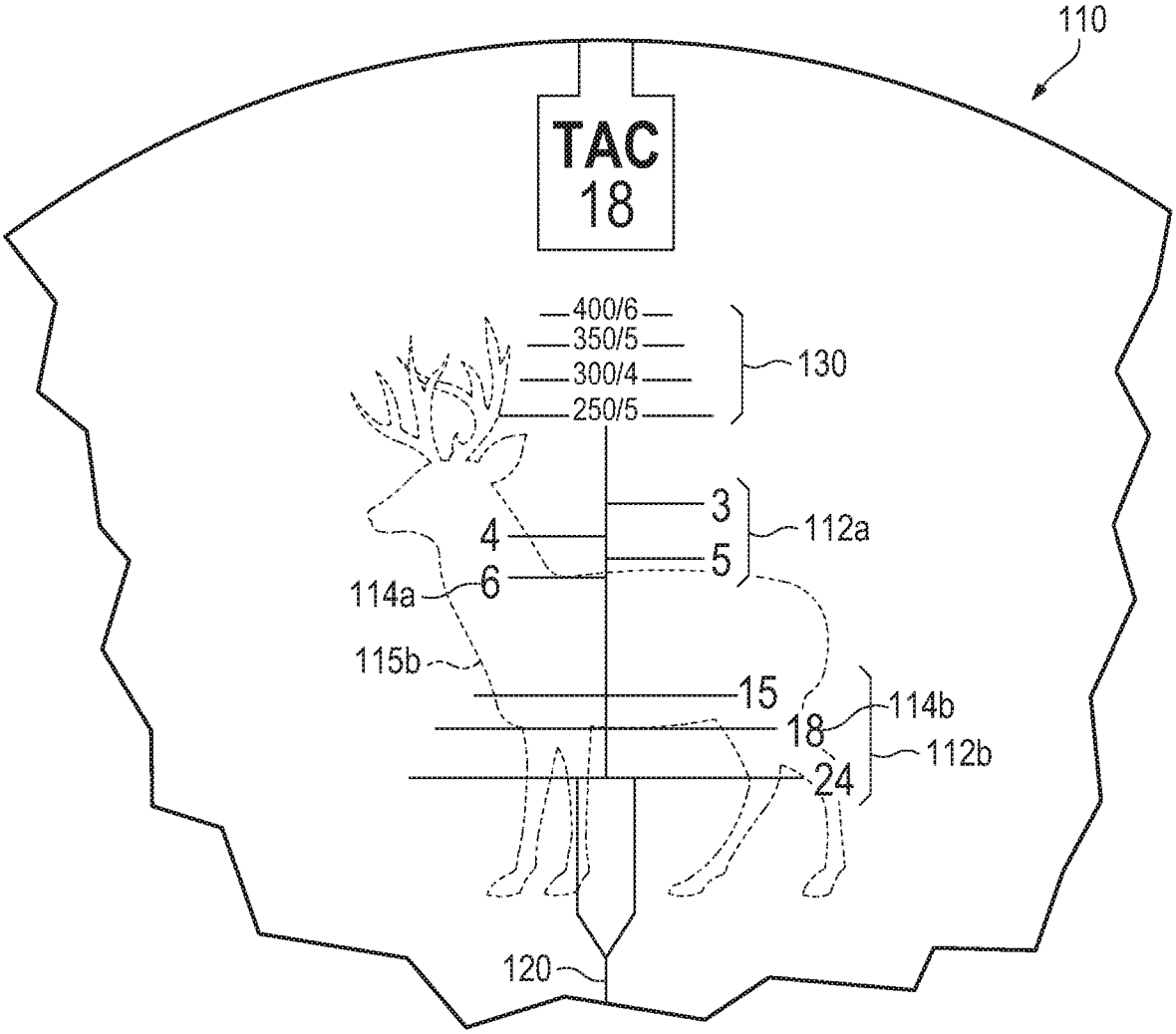
FIG. 4*b* is a view of a mule deer buck at 400 yards, on the reticle of FIG. 3.

In use of the scope 10 having reticle design 110, a shooter chooses a line from the set of second lines 112*b* based on pre-knowledge of the vertical height of the target. For example, it is well known that an adult Black Tail Deer measures 15" from back to brisket (the bottom of the rib cage), as does an Antelope, a Coues Deer and a Texas White Tail Deer. Accordingly, if the shooter were taking aim at one of those creatures, he would choose the second line 112*b* that is marked with a "15" indicium 114*b*. Then, he determines which one of the first lines 112*a* forms a pair with the selected second line 112*b* that brackets the buck from back to brisket (the bottom of the rib cage). FIG. 4*a* shows a Black Tail Buck 115*a* at 300 yards, subtending the pair of lines formed by the line 112*b* marked with a "15" indicium 114*b* and the line 112*a* marked with the "4" indicium 114*a*, indicating that 4 minutes of angle are required to compensate for bullet drop to the target, which is at about 300 yards. In FIG. 4*b* a Mule Deer Buck 115*b* is shown subtending the pair of lines formed by the line 112*b* marked with an "18" indicium 114*b* and the line 112*a* marked with a "6" indicium 114*a*. The indicia 114*a* and 114*b*, each reflect a target measurement made from the top of a second line 112*b* to the bottom of a first line 112*a*, as opposed to a measurement from the center of a second line 112*b* to a center of a first line 112*a*. With this innovation none of the target is blocked by either line 112*a* or 112*b*, both of which have some finite width, which would otherwise introduce uncertainty to the process of fitting a target to a pair of lines.

Notably, the reticle design shown also permits aiming at a mule deer, using a line selected from the second set of lines 112*b*, and marked at "18" by the indicium 114*b*, reflecting the 18" distance from the back of a mule deer to the bottom of the brisket. Similarly, the second lines also permit ranging a cow elk, by using the line marked with indicium 114*b* as "24," reflecting the distance in inches from the back to the brisket of an adult cow elk.

Figure 4C:
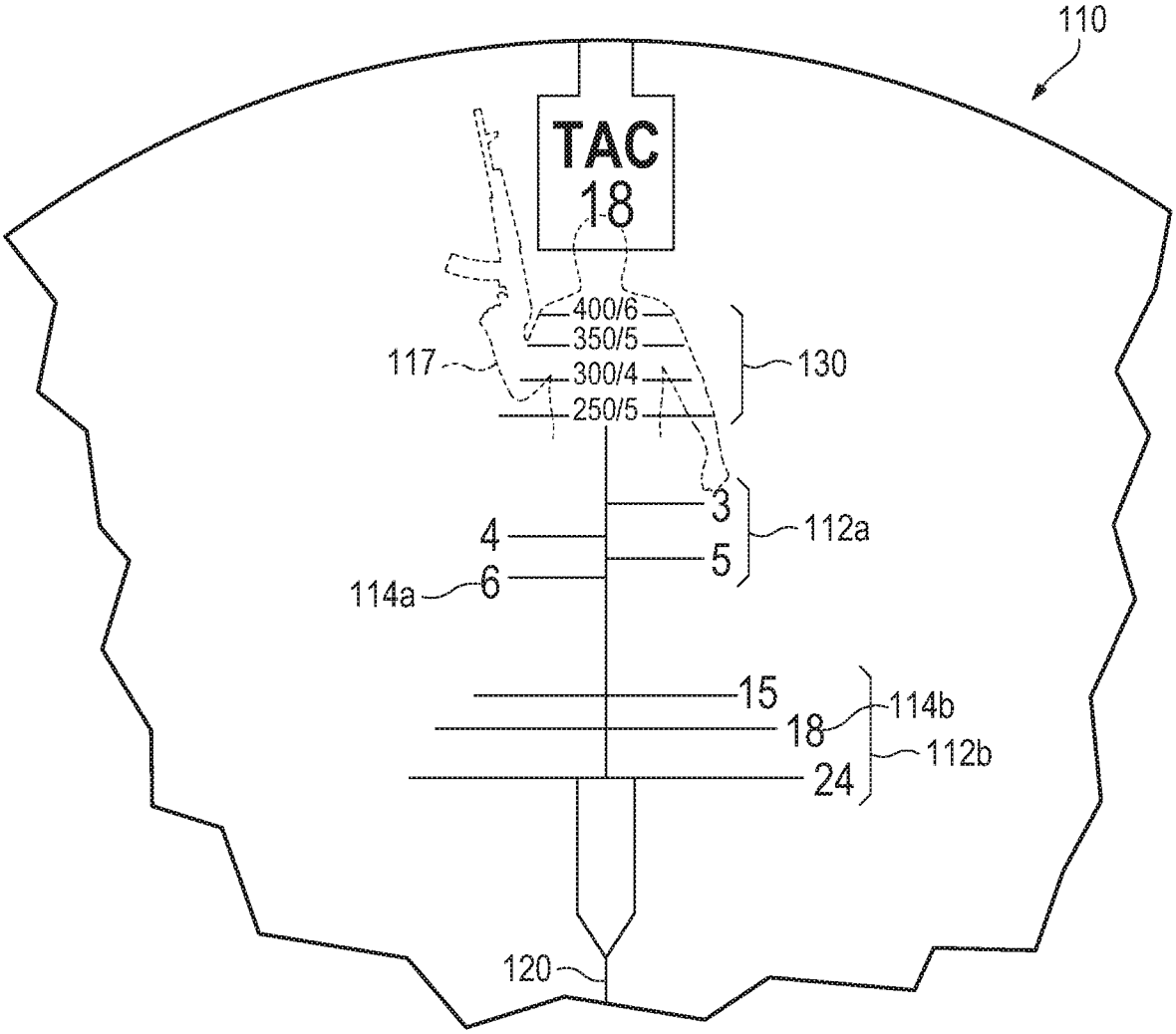
FIG. 4*c* is a view of a human figure at 400 yards.

A set of third lines 130, are provided for quickly measuring the range to a target that is 18" in width, such as an m-target. This is indicated by the "TAC 18" icon at the very top of the reticle pattern. Third lines 130 are each marked by the range in yards to an 18" width target that fits the line width, and the minutes of angle of bullet drop that will occur over that range, in a format of "range/bullet drop". To use lines 130 a shooter determines which line best fits the 18" width target and reads the bullet drop indicium in the middle of the line 130 that best fits the shoulder width. FIG. 4*c* shows lines 130 being used to range an m-target 117. An m-target is typically 18 inches across at the back, with the top line of lines 130 indicating that the figure is at 400 yards.

Figure 4D:
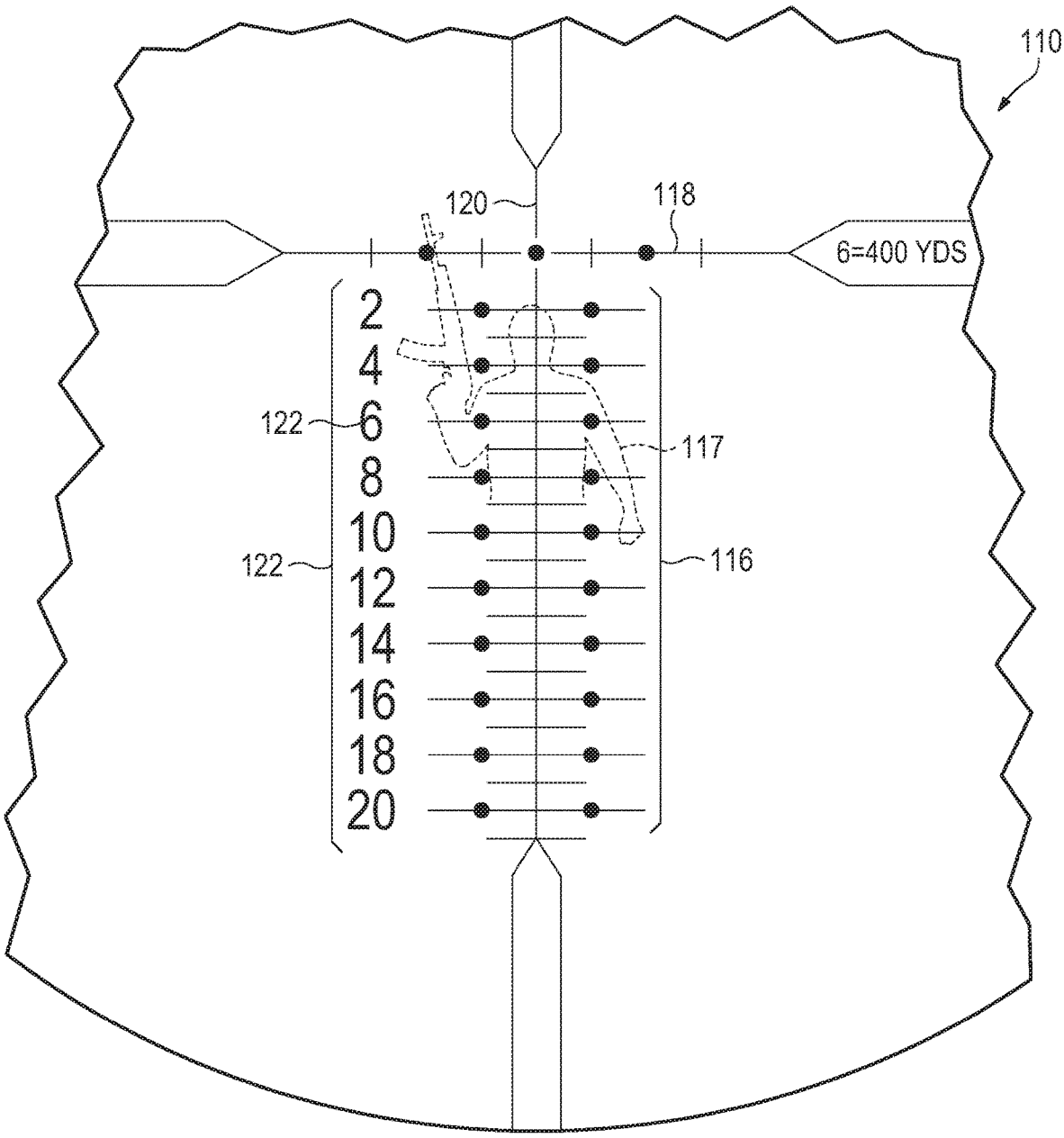
FIG. 4*d* is a view of the reticle aimed at the human figure as informed by the ranging of FIG. 4*c*.

Referring to FIG. 3 and FIG. 4*d*, a set of marks 116, below the horizontal line 118, in the embodiment shown taking the form of a set of lines, crossing a vertical line 120, but which could also be some other shape, and marked with indicia 122, that match indicia 114*a*. So, in the Black Tail Buck example presented above, the shooter places the mark 116 bearing the indicium "4" on the target, thereby lifting a rifle attached to the scope up by 4 minutes of angle, enough to compensate for the bullet drop to the target. In the Mule Deer example, the hunter would place the mark 116 bearing the "6" on the target. FIG. 4*d* shows the reticle being used to aim at the human FIG. 117, with the center of the line 116 that is marked with a "6" by an indicium 122, placed over the heart location of the FIG. 117, as was indicated by the ranging performed in FIG. 4*c*.

Figure 5:
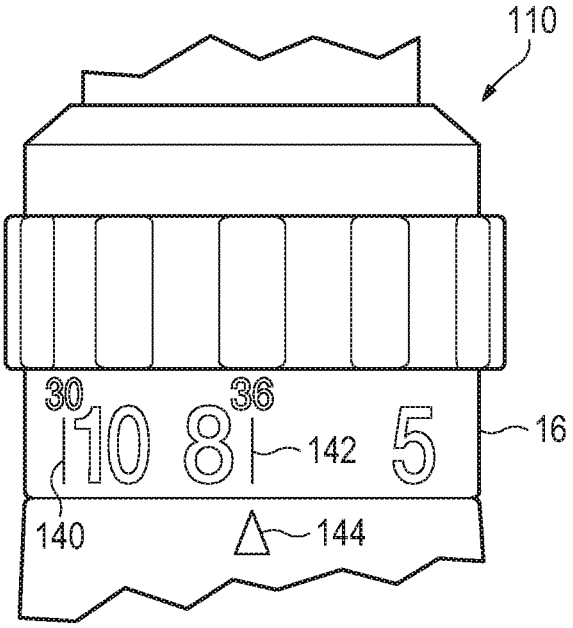
FIG. 5 is an isometric view of the zoom ring of the scope of FIG. 1.

Referring to FIG. 5, zoom selector ring 16 is marked with two marks 140 and 142, as shown "30" and "36," respectively. When the numeral 30 is chosen (the zoom selector ring 16 is moved so that the number is aligned with alignment mark 144, providing a lower level of magnification), and thereby calibrating the line "24" (FIGS. 3, 4*a*, 4*b*, 4*c*) as a "30" or "36" inch target size indicating line. Then the line 112*b* marked with a "24" can be used to range a larger target, that is 30" high. But if the numeral "36" is chosen, then the line 112*b* marked with a "24" can be used to range targets that are 36" vertically, for example a bull elk, in the same way that the same line can be used to range a cow elk when the zoom selector ring 16 is turned to "24". In the instance of using these lower magnification levels, the indicia of the marks 116 do not reflect the minutes of angle necessary to correct for bullet drop. Some hunters may be knowledgeable enough to correct for the lower magnification level in the use of marks 116. Alternatively, a hunter may turn the zoom selector ring 16 to the highest level of magnification, and then use marks 116, which will accurately compensate for the bullet drop determined in the previous step, or he can use the elevation knob 17 (FIGS. 1 and 2) to correct for bullet drop. If the reticle lens 14 (FIG. 2) is in the first focal plane, zoom adjustments do not affect the spacing of the reticle lines, relative to images in the field of view. The user may use marks 116 to compensate for bullet drop, or the elevation knob 17, informed by the minutes of angle markings of lines 112*a*.

Finally, in an additional feature, a legend 130 permits those using a laser range finder to quickly convert the range provided by the range finder to minutes of angle, which may then guide the usage of marks 116, in the pointing up of a fire arm that is attached to scope 10, to a degree that compensates for bullet drop, to the range of the target.

Generally speaking, a user may alter the position of horizontal line 118 relative to the boresight of the rifle, to compensate for the type of cartridge being used, according to well-known techniques.

Figure 6:
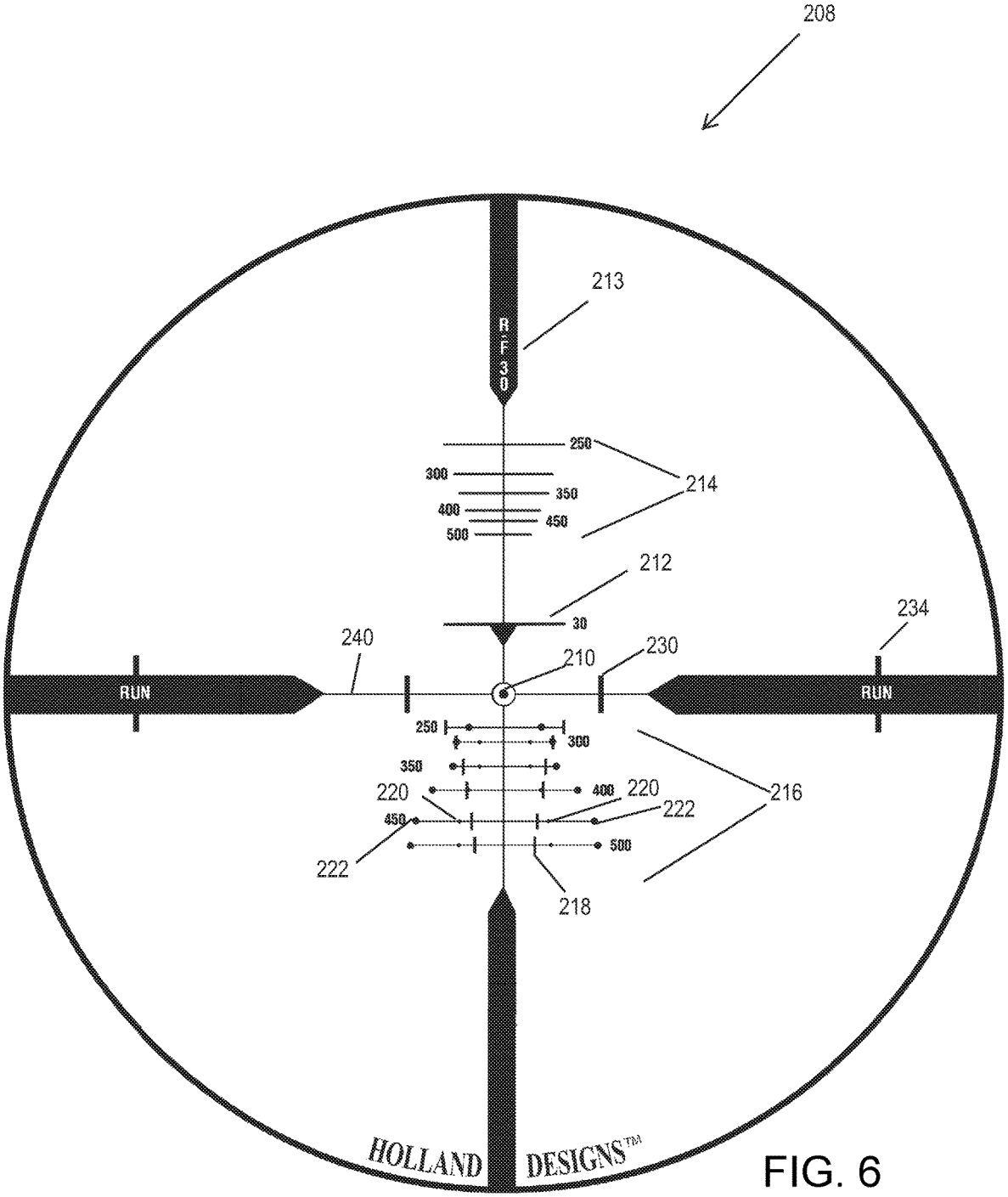
FIG. 6 is an anti-personnel reticle, as seen through a scope.

Referring now to FIG. 6, an anti-personnel reticle 208 is designed for shooting at an m-target. The following discussion applies to the instance where the reticle 208 is placed at the first focal plane, in which case the zoom setting does not affect the proportions of the reticle markings on the field of view, of for a specific zoom magnification level, typically the highest zoom level, if the reticle 208 is placed at the second focal plane. A center point 210 may be aligned relative to the direction of a bullet exiting the barrel of an attached rifle, to compensate for the bullet drop to a target at a range of 100 yards, for a first known type of cartridge. The phrase "first known type of cartridge" refers to a specific designation of cartridge, which the user knows he is using. The user may be advised, by a computer-generated result, based on the type of cartridge being used, to align the center point to a different range, for example 125 yards. Alternatively, the user may align the 500-yard mark, to a target at 500 yards. A base line 212, has a numeral "30" beside it to the right, referring to the number of inches from the m-target belt, to the top of its head. This number is also repeated in a marker 213, at the top of the reticle, preceded by the letters "RF" for "range finder." A set of top lines 214, are each accompanied by a numeral to the right. When the base line 212 is aligned to an m-target's belt, the number adjacent the top line 214, when it aligns with the m-target's head-top provides an estimate of the range to the m-target in yards. The width of each line 214 is equal to the 18-inch width of an m-target's shoulders, if the m-target is squarely facing the shooter and is at the range in yards indicated by the numeral adjacent the line 214, as the m-target appears through the scope. A set of aiming lines 216, providing aiming levels corresponding to the range in yards to the target. So that if the target has been ranged at 350 yards, then if the aiming mark 216 adjacent the numeral 350 is placed over the target, the gun barrel will be raised by just enough to compensate for bullet drop, for a first known type of cartridge. Different cartridges result in different muzzle velocities, which affect bullet drop. Accordingly, marks 216 and the adjacent numerals are set for at least a first known type of cartridge. Each mark 216 is intersected by a pair of short vertical lines 218, giving the width at the shoulders of an m-target (18 inches), so that if the m-target is squarely facing the shooter, the shooter can find the pair of lines 218 that fit his width at the shoulders, and already have the rifle pointed up enough to just compensate for bullet drop, for the first known type of cartridge. Small dots 220 are intended to compensate for a cross-wind of 5 mph, whereas large dots 222 are to compensate for a 10 mile an hour wind. Marks 230 and 234 on centerline 240, are to compensate for the movement of a walking or a running target, respectively, between the time a bullet is fired and it reaches the range of the target. The word "RUN" on the horizontal center line markings is for a quick reminder to the shooter.

Figure 7:
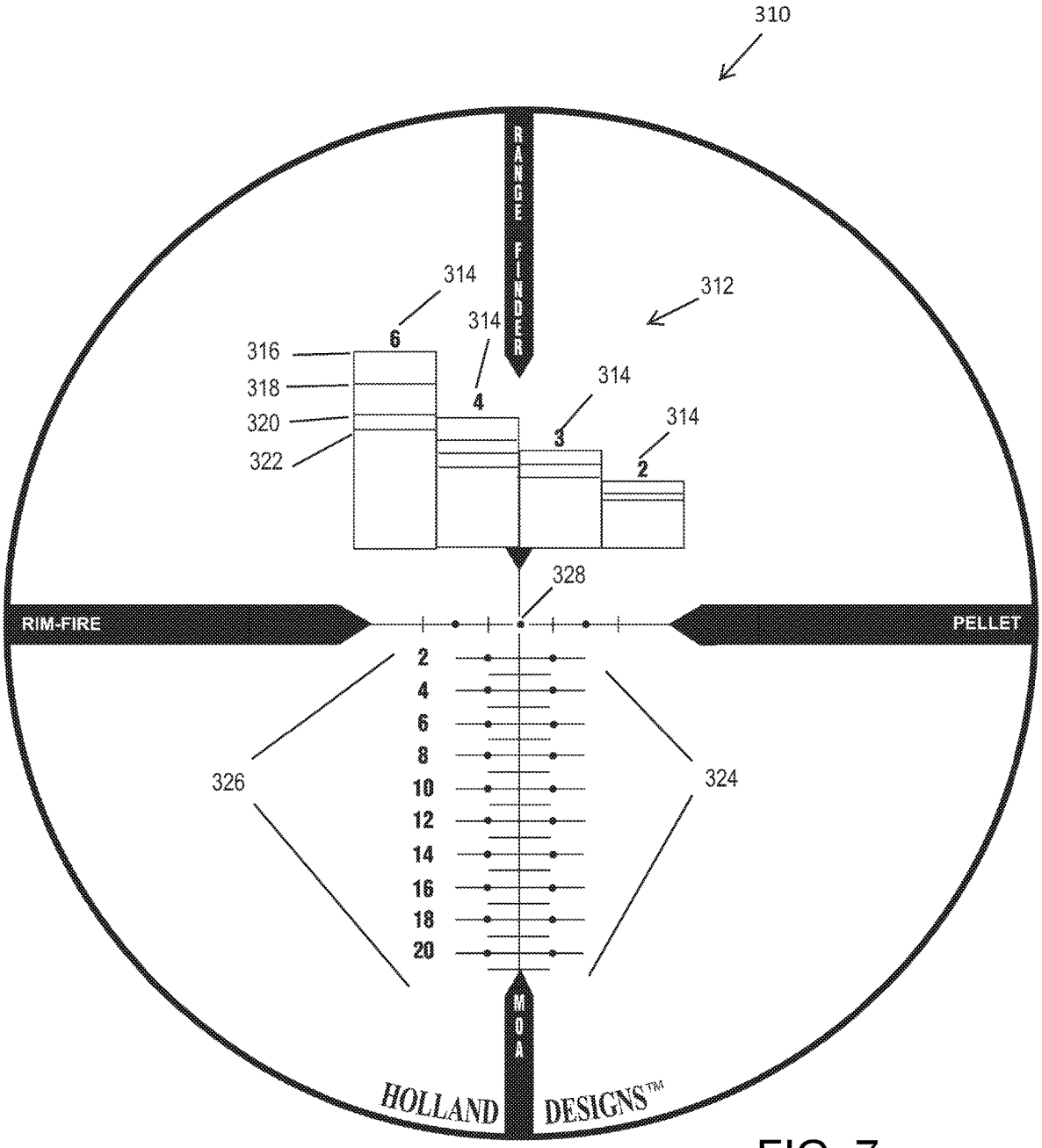
FIG. 7 is a reticle for a pellet gun, as seen through a scope.

Referring now to FIG. 7, a pellet gun reticle 310, which could also be used for example when using rim-fire cartridges in a 0.22 caliber rifle, takes advantage of the fact that in the sort of short-range shooting typically performed with a pellet gun, the shooter is likely engaged in practice with a target of known dimension. The set of vertical bars 312 represents differing target heights, with the numeral 314 atop each vertical bar representing the target height in inches, and the height of the bar 316 corresponds to the vertical reticle-space taken up by a target of that height, if the target is at a range of 50 yards. A line 318, just one down from the top 316 corresponds to a target at 60 yards, a line 320 two down from the top corresponds to a target at 70 yards, and a line 322 three down from the top corresponds to a target at 80 yards. A set of aiming lines 324, are each marked with a numeral 326 giving the minutes of angle that the gun will be pointed up over a center point 328, when the aiming line 324 is aligned with the target. A shooter can determine the range to the target using the appropriate bar 312 (based on his foreknowledge of the target height) and then use that range to calculate the minutes of upward angle needed to compensate for bullet (or pellet) drop, and then use lines 324 to guide him to aim his gun at that upward angle.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A rifle and rifle scope assembly, comprising:

(a) a rifle;

(b) a rifle scope housing, attached to said rifle, said housing defining an eyepiece;

(c) an optical train, in said housing;

(d) a reticle lens, in said optical train; and (e) wherein when a user looks through said eyepiece, said reticle lens presents a display having:

(i) a set of first horizontal lines, each marked by an indicium;

(ii) a set of second horizontal lines, each marked by an indicium;

(iii) a first one of said first horizontal lines and a first one of said second horizontal lines forming a first pair of lines, spaced apart by a distance that fits the distance on an m-target, from the belt to the top of the head, as seen through said scope, if said m-target is at a range that results in bullet drop of a first known amount, for a first known type of cartridge;

(iv) wherein said first one of said first horizontal lines is labeled with a first indicium; and (v) further wherein a set of marks, includes a first mark which will, if placed on a target, result in an elevation angle, relative to said target, that will compensate for said first known amount of bullet drop, for the first known type of cartridge, and wherein said first mark is also marked with said first indicium; and (f) whereby a user can determine that an m-target fits said first pair of lines, from belt to head-top, read said first indicium, find a mark marked with said first indicium, position said rifle so that when said user views said m-target through said eyepiece, said mark is superimposed on said m-target, and shoot, thereby quickly compensating for bullet drop at range to said m-target, for the first known type of cartridge.

2. The assembly of claim 1, wherein said second set of horizontal lines includes a single horizontal line, only.

3. The assembly of claim 2, wherein said single horizontal line that comprises said second set of lines is marked by a numeral 30, indicating the distance of 30 inches from the belt of an m-target to the top of an m-target head.

4. The assembly of claim 2, wherein said indicia marking said first horizontal lines and said markings are numerals indicating units of distance, indicating range to target.

5. The assembly of claim 4, wherein said set of second horizontal line is beneath said first horizontal lines and said indicia reflect the units of distance, reflecting range to an m-target that fits the distance from the top of said second line to the bottom of said first line.

6. The assembly of claim 4, wherein said units of distance are yards.

7. The assembly of claim 1, wherein said reticle first horizontal lines are of differing lengths, each length fitting the 18-inch width of an m-target at the range in yards indicated by the indicia adjacent said first horizontal line.

* * * * *